US005546625A

United States Patent [19]

Mealey, Sr.

[11] Patent Number: 5,546,625

[45] Date of Patent: Aug. 20, 1996

[54] MULTIPURPOSE PAINTER'S TOOL

[76] Inventor: Eddie H. Mealey, Sr., 158 McLay Ave., East Haven, Conn. 06512

[21] Appl. No.: 502,306

[22] Filed: Jul. 13, 1995

[51] Int. Cl.[6] ..... B05C 17/10; B26B 9/02; B25B 27/00

[52] U.S. Cl. ..... 15/105; 15/236.01; 15/236.03; 15/236.05; 15/236.07; 30/357; 29/270; 29/280; 7/105

[58] Field of Search ..... 15/105, 236.01, 15/236.03, 236.05, 236.06, 236.07, 236.08, 104.04; 7/105, 138, 143, 144, 151, 156, 158, 166; 30/351, 355, 357, 169; 29/270, 278, 280

[56] References Cited

U.S. PATENT DOCUMENTS

| | | | |
|---|---|---|---|
| 27,141 | 6/1897 | Crossman | 30/169 |
| 960,624 | 6/1910 | Compton | 7/105 |
| 1,355,574 | 10/1920 | Ryberg | 15/104.04 |
| 1,549,044 | 8/1925 | Rader | 29/278 |
| 2,611,181 | 9/1952 | Coulter | 7/156 |
| 2,761,165 | 9/1956 | Krzanowski . | |
| 2,824,323 | 2/1958 | Tos | 15/104.04 |
| 2,825,916 | 3/1958 | Basala, Jr. . | |
| 2,860,858 | 11/1958 | Kurs | 15/236.03 |
| 2,961,683 | 11/1960 | Meyer . | |
| 3,373,456 | 3/1968 | Dalton . | |
| 3,724,010 | 4/1973 | Scholl | 7/105 |
| 4,287,631 | 9/1981 | Marrs | 15/105 |
| 4,324,018 | 4/1982 | Olsson | 15/236.03 |
| 4,565,004 | 1/1986 | Heinz | 7/105 |
| 4,667,361 | 5/1987 | Wolcott et al. . | |
| 4,982,471 | 1/1991 | Bannan . | |
| 5,063,627 | 11/1991 | Marra | 7/105 |
| 5,226,647 | 7/1993 | Notarmuzi | 15/236.08 |
| 5,228,159 | 7/1993 | Gurka . | |
| 5,251,352 | 10/1993 | Cullison | 7/105 |
| 5,272,782 | 12/1993 | Hutt | 15/236.03 |
| 5,283,923 | 2/1994 | Schaedel | 15/230.11 |
| 5,392,484 | 2/1995 | Stoltzfus | 15/236.07 |

FOREIGN PATENT DOCUMENTS

| | | | |
|---|---|---|---|
| 18540 | 3/1914 | Denmark | 15/104.04 |
| 61510 | 11/1943 | Denmark | 15/104.04 |
| 0016871 | of 1894 | United Kingdom | 15/236.03 |
| 2270464 | 3/1994 | United Kingdom | 15/236.03 |

*Primary Examiner*—David Scherbel
*Assistant Examiner*—Randall E. Chin
*Attorney, Agent, or Firm*—Delio & Peterson

[57] ABSTRACT

A multipurpose painter's tool having a blade and handle. The blade has an essentially circular aperture at the base edge thereof defining a collar for stripping roller sleeves from paint roller tools and is provided with an arcuate surface in a side edge of the blade for removing paint from a paint roller. At an apex in the base edge there is provided a projecting boss which cooperates with an adjacent knife edge for use in freeing plastic lids of large paint cans of the type in which the lid has an apertured depending skirt. Work areas are provided between the collar and the side edges of the blade for performing various scraping and puttying functions, opening small paint cans and tightening and loosening wing nuts. At the bottom of the handle there is provided a hammerhead for setting nail pops.

7 Claims, 2 Drawing Sheets

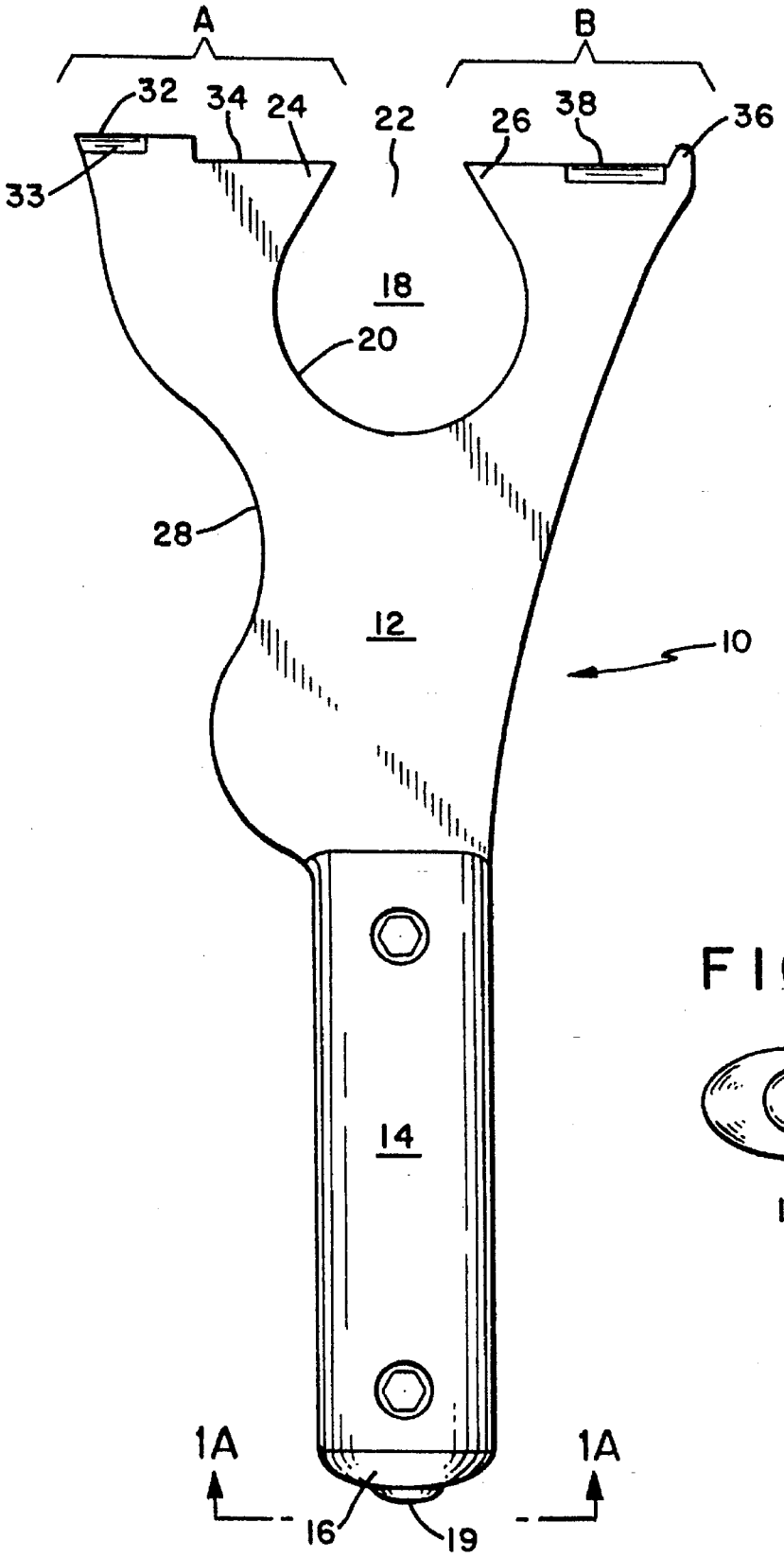
FIG. 1
FIG. 1A
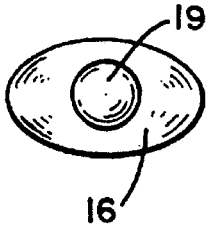

FIG. 2
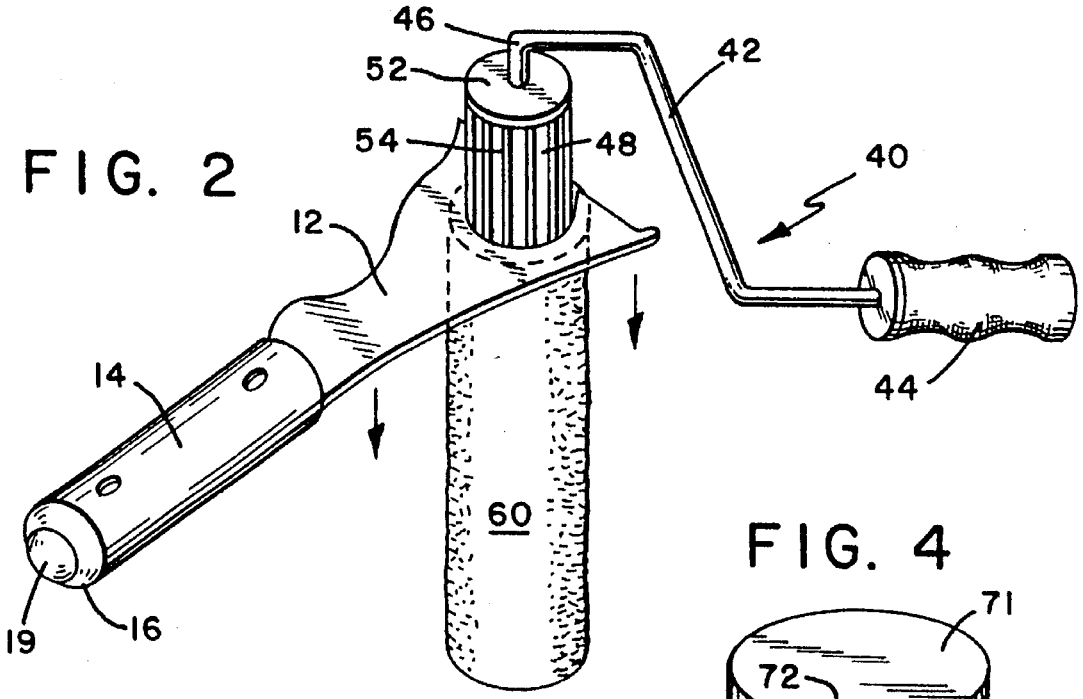
FIG. 4
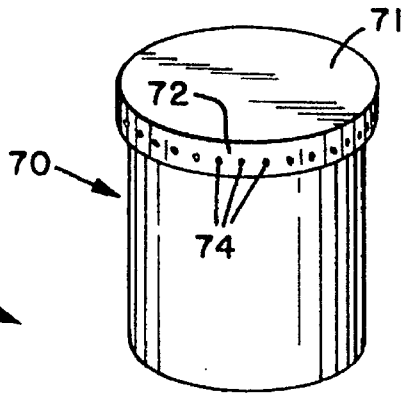
FIG. 3
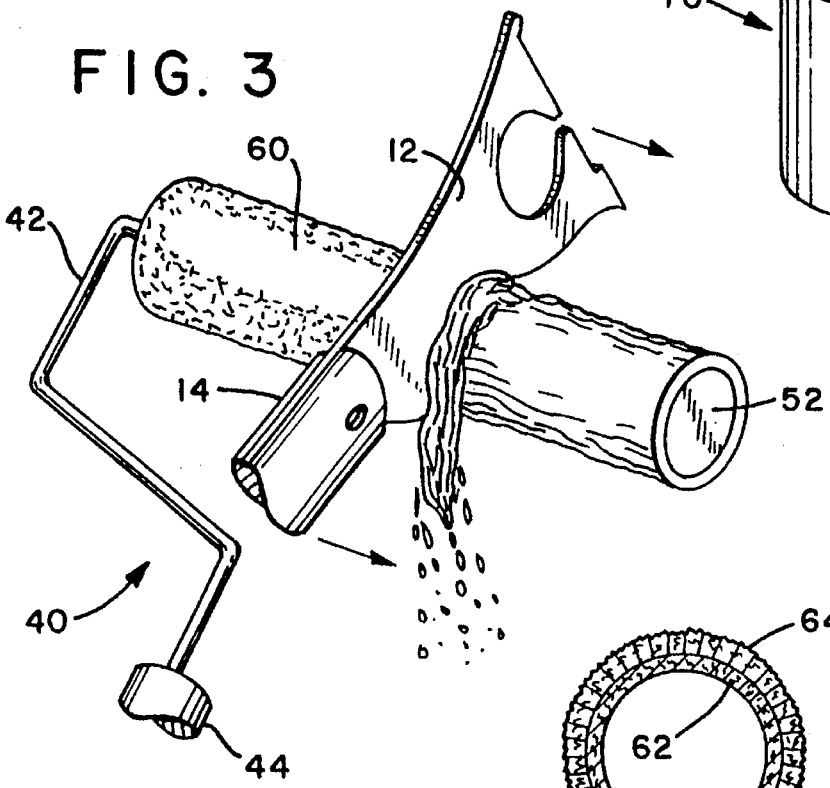
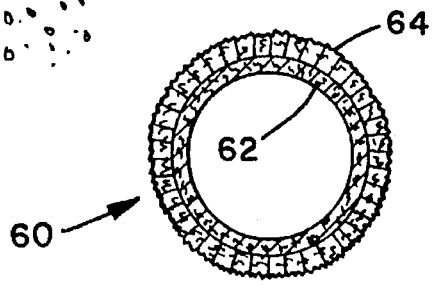
FIG. 5

MULTIPURPOSE PAINTER'S TOOL

BACKGROUND OF THE INVENTION

1. Field of the Invention

This invention is related to an accessory tool for use in various tasks performed by painters, particularly painters employing paint rollers.

2. Description of Related Art

There are numerous subsidiary tasks which a painter must perform as he goes about his primary work of applying paint to the various surfaces required. For example, a painter using paint rollers must change the sleeves on the paint rollers frequently and from time to time must scrape the paint off the paint roller as he works. In addition, he must open paint pails, putty holes in trim, unscrew switch plates, clean sash corners and perform a variety of scraping operations.

Various devices have been previously disclosed for accomplishing one or several of the above tasks.

In particular, a number of devices have been previously disclosed for removing paint from rollers and for removing rollers from the roller handles. Thus, U.S. Pat. No. 2,761,165 to Krezanowski, is a paint removal device made of wire for use with rollers made of sponge material which would be of limited usefulness with nap type rollers commonly used. U.S. Pat. No. 4,287,631 to Marrs, shows another wire type for paint removal device which would be relatively ineffective with vary thick naps. U.S. Pat. No. 2,961,683 to Meyer, is a tong device for cleaning and removing the paint roller. This is a relatively complicated and cumbersome device and grips the roller in a squeezing action for removal which would tend to crush or deform the relatively fragile roller and once deformed it would be difficult to slide off the paint roller. The Wilcox et al. U.S. Pat. No. 4,667,361 is a paint roller cleaner and sleeve remover comprising two semi-cylindrical halves which are hinged together. Each half of the tool has an inwardly extending flange at a corresponding one of their ends. The flange extends inwardly to a diameter approximately equal to or very slightly greater than the inner diameter of the core of a typical paint roller. The curved edge on one of the halves can be pressed against the roller to scrape paint from the roller nap. The roller sleeve itself is removed by closing the device surrounding one end of the paint roller and with the inner margin of the flange abutting the end of the roller core. The roller may then be slid off the paint roller tool. This tool is somewhat awkward to use and is limited to the two functions described.

A simple device capable of both cleaning and removing paint rollers and performing other tasks with which the painter is faced, is highly desirable.

Bearing in mind the problems and deficiencies of the prior art, it is therefore an object of the present invention to provide a relatively simple blade tool capable of removing the roller sleeves from a paint roller tool without damaging the roller tool and also having means for scraping paint from the roller sleeves.

It is another object of the present invention to provide a multipurpose tool having means for opening both small and large paint cans.

It is a further object of the invention to provide on a multipurpose tool knife edges for scraping paint from windows and small broad surfaces for applying patch compounds.

It is yet another object of the invention to provide at the handle of a multipurpose painter's tool a hammer surface for setting nail pops.

Still other objects and advantages of the invention will in part be obvious and will in part be apparent from the specification.

SUMMARY OF THE INVENTION

The present invention provides a one piece combination tool which includes a paint roller cleaner and sleeve remover and provides surfaces and edges for cleaning, scraping, applying putty, driving screws, opening paint pails and setting nails.

The tool of the invention comprises a blade element and a handle element. The exposed blade portion of the blade element is roughly triangular in shape and is provided with an approximately circular cut out or opening at the base edge thereof forming a collar having an open side at the base of the triangular blade portion. This collar has the function of removing paint roller sleeves from the roller tool. At one side of the blade portion there is an inwardly arcuate edge for performing the function of cleaning the paint off the roller sleeves. At the base angles of the triangular blade portion, there are provided edges, surfaces and apices which serve a number of functions useful to the painter. The base edge of the triangular blade portion is nonuniform in configuration having an upwardly extending projection or boss adjacent one base angle or apex while adjacent the other base angle or apex there is a short base edge extension comprising a knife edge originating at the apex and smoothly adjoining a short unsharpened edge which completes the edge extension. At a slightly lower level between the boss and the edge extension the base edge is straight, though interrupted where intersected by the circular opening. A knife edge adjoins the boss on the base edge and transforms to an unsharpened edge in reaching the circular opening. The apex associated with the base edge extension has a sharpened end point which can serve as a pry to open paint pails or clear accumulated paint to free lids. The knife edge on the base edge extension can be used for cleaning inside and outside sash corners and for glazing windows, while the smooth edge adjacent the knife edge is useful for putty application, trimming edges and scraping. The boss referred to above is used in conjunction with the adjoining knife edge. This region of the tool is useful in opening five gallon paint cans which have plastic lids with skirts depending therefrom having a series of apertures around the circumference. Removing lids of the type described may be greatly facilitated by inserting the boss of the tool into one of the aforementioned skirt apertures so that the boss is between the side of the pail and the lid skirt. The tool is then moved downwardly bringing a knife edge into contact with the plastic skirt and slicing entirely through the plastic to the periphery of the skirt and repeating this operation with several apertures until the lid is well loosened.

The collar aperture, as described previously, intercepts the base of the blade portion and so leaves a pair of horn like extensions which reach toward each other. These extensions may be used to tighten and loosen wing nuts on certain rollers. At the base of the handle portion, a butt hammerhead is provided which is a metal member of brass or steel which can serve to set nail pops

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

FIG. 1 is a plan view of the multifunctional tool of the invention.

FIG. 1A is a view taken along line 1A—1A of FIG. 1 showing an end view of the butt hammerhead.

FIG. 2 is a perspective view of the tool of the invention illustrated in removing a paint roller sleeve from a roller tool.

FIG. 3 is a perspective view of the tool of the invention illustrated in scraping paint from a paint roller.

FIG. 4 is a view in perspective of a five-gallon paint can with plastic lid.

FIG. 5 is a sectional view of a roller sleeve.

DESCRIPTION OF THE PREFERRED EMBODIMENT(S)

In describing the preferred embodiment of the present invention, reference will be made herein to FIGS. 1–5 of the drawings in which like numerals refer to like features of the invention. Features of the invention are not necessarily shown to scale in the drawings.

Referring to the drawings, the multipurpose tool 10, formed of hardened tool steel, comprises a blade member 12, preferably full tang, and a handle member 14. The blade member 12 is roughly triangular in shape which may be considered to extend from an apex in the handle to a relatively broad base with tool sections A and B. A generally central and circular opening 18 is provided intersecting the base between tool sections A and B. The intersection of opening 18 with the base leaves an open space 22 in the base between extending arms 24 and 26 of blade member 12. The opening 18 defines a collar 20 in blade member 12 having a circumference greater than 180° which is sized to a diameter approximately equal to or slightly greater than the mandrel of a typical paint roller.

In the side of blade member 12 there is provided an inwardly curved arcuate scraping surface 28. Curved surface 28 closely approximates the arc of a portion of the circumference of a paint roller.

Tool section A includes a base edge extension having a sharpened portion 32 and a smooth base edge portion 34.

Tool section B includes a boss or projection 36 and a knife segment 38 extending a short distance from boss 36 toward opening 22. Boss 36 may be machined to form a Phillips head screwdriver, if desired.

The lower end of handle 14 may be provided with a brass or hardened steel member 16 shaped to a dome projection at 19 to form a butt hammerhead.

The multipurpose tool described above has certain functions performed upon paint rollers and a description of a typical paint roller follows with reference to FIGS. 2, 3 and 5. As shown in FIGS. 2 and 3 paint roller 40 is constructed of heavy wire or rod 42 which has a handle or hand grip 44 at one end and an axle portion 46 at the other end on which is rotatably mounted a sleeve support or mandrel 48. The ends of mandrel 48 are closed and supported for rotation on the axle portion 46 of the paint roller 40 by end caps 52. The diameter of end caps 52 normally does not exceed the diameter of mandrel 48. Relatively stiff wires 54 extend between end caps 52 and are bowed or arched outward slightly to frictionally engage the interior of the paint roller sleeve to be mounted thereon. A typical paint roller sleeve 60 consists of a hollow cylindrical core 62 having a nap 64 thereon for holding and spreading paint. The inside cylindrical surface of roller core 62 engages the bowed wires of mandrel 48 in a tight fit so that roller sleeve 60 is frictionally held on mandrel 48 and rotates with it.

Multipurpose tool 10 is intended to aid in many of the tasks confronting a workman in painting. Stripping paint roller sleeves from the mandrels on which they are mounted and cleaning or scraping the sleeves are two common jobs which must be performed as the work progresses. When a paint roller is in use, paint tends to accumulate between the mandrel and the paint roller sleeve making it difficult to remove the sleeve from the mandrel.

In stripping paint roller sleeves, the open space 22 allows tool 10 to pass rod 42 of paint roller 40 and place collar 20 in a position about an inner end cap 52 with the edge of collar 20 abutting the cylindrical core 62 of sleeve 60. With the tool thus positioned in a plane perpendicular to the axis of the mandrel pressure can then be exerted by collar 20 on cylindrical core 62 to strip sleeve 60 from mandrel 48, as illustrated in FIG. 2, by pushing the core in the direction of the arrows longitudinally parallel to the axis of the mandrel. Force is thus applied only to core 62 of the sleeve and not to the mandrel. Even stubbornly attached sleeves can be stripped in this manner without damage to the mandrel or to the paint roller handle.

FIG. 3 illustrates use of tool 10 in cleaning or scraping the paint roller sleeve 60. In this case, the arcuate surface 28 of tool 10 is applied to the paint-filled nap 64 of roller sleeve 60 and moved in the direction indicated by arrows in FIG. 3 to remove the paint.

Another feature of importance is shown at 36, 38 in FIG. 1 which identifies a device for opening the plastic lid of a five gallon paint bucket 70 shown in FIG. 4. Lid 71 of the paint bucket has a downwardly depending skirt 72 provided with a plurality of perforations 74 about its periphery. In order to remove lid 71 ,some or all of the perforations 74 must be cut downwards through to the perimeter of skirt 72 so that the skirt can be expanded for removal of lid 71 from paint bucket 70. This cutting operation is accomplished by inserting boss 36 of tool 10 into a perforation 74 so that the boss extends into the space between the pail proper and the lid skirt and then the tool is pushed vertically downward to cause sharpened edge 38 to cut the plastic skirt 72 from the bottom of perforation 74 entirely through the perimeter of the skirt. The cutting operation is repeated on a number of perforations 74 until the skirt 72 can be sufficiently expanded and lid 71 removed from the paint bucket.

In tool section A, there is provided a sharpened edge 32 for performing cleaning and scraping operations on the inside and outside corners of windows and sashes. The apex 33 in tool section A is set at a less than 90 degree angle forming a pry for removing lids on smaller paint cans. Also in tool section A, there is a smooth edge segment 34 which is suitable for use as a putty knife.

Between tool sections A and B arms 24 and 26 extend toward each other defining the open space 22 where circular opening 18 intersects the base of tool 10. The arms 24 and 26 provide tool surfaces which are used for tightening and loosening wing nuts found on larger (18 inch) paint roller handles.

In tool section B, boss 36 may be machined to the form of a Phillips head screwdriver.

The end of handle 14 of tool 10 is provided with a solid brass or steel end piece 16 having a domed projection 19.

This domed projection 19 serves as a hammer surface to set nail pops encountered in the painter's work.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A multipurpose painter's tool comprising:

a blade member of generally triangular configuration and a handle secured thereto, said blade member having a base edge, a side edge, and first and second apices on the base edge remote from said handle;

an inwardly curved arcuate edge formed on the side edge of said blade member for removing paint from a paint roller sleeve;

a generally circular opening centrally intersecting said base edge forming an open space in said base edge and defining a collar in said blade member for stripping a roller sleeve from a paint roller;

a first tool section in the blade member at one side of said collar adjacent to the first apex; and a second tool section in the blade member at the other side of said collar adjacent to the second apex;

a boss in said second tool section projecting outward at said second apex and a knife edge extending from said boss along said base edge toward said open space; and the boss and knife edge cooperating to free lids on large plastic paint cans.

2. The multipurpose painter's tool of claim 1 wherein the first apex in said first tool section defines an angle of less than 90° forming a pry for opening paint cans and clearing accumulated paint to free lids on paint cans.

3. The multipurpose painter's tool of claim 2 wherein said first tool section includes a base edge extension having a knife edge adjacent the apex in said first section for cleaning inside and outside sash corners, and a smooth edge portion adjacent said knife edge of said first tool section for putty application, trimming edges and scraping.

4. The multipurpose painter's tool of claim 3 wherein said collar includes a pair of wing-like appendages extending toward each other to define said open space, said appendages useful in tightening and loosening wing nuts.

5. The multipurpose painter's tool of claim 4 wherein hammer means is provided on an end of said handle.

6. A multipurpose painter's tool comprising:

a handle member;

a blade member of generally triangular configuration mounted on the handle member;

said blade member having a base edge remote from said handle member and first and second extremities at opposite ends of the base edge;

a generally circular opening centrally intersecting said base edge to form an open space in said base edge and defining a collar in said blade member, said collar having a diameter sized to contact the end of a paint roller sleeve and having a circumference substantially greater than 180° so that it may engage and remove said paint roller sleeve from said paint roller;

a boss at the first extremity of said base edge adjoining a first knife edge portion of said base edge for opening large plastic paint cans;

a base edge extension having a second knife edge thereon at the second extremity of said base edge for cleaning inside and outside sash corners and for glazing, said second knife edge adjoining an unsharpened edge for service in applying putty and scraping; and a hammer surface provided at an end of said handle.

7. A painter's tool for removing a paint roller sleeve from a paint roller comprising:

a blade member of generally triangular configuration and a handle secured thereto, said blade member having a base edge remote from said handle; and a generally circular opening centrally intersecting said base edge forming an open space in said base edge and defining a collar in said blade member, said collar having a diameter sized to contact the end of a paint roller sleeve and having a circumference substantially greater than 180° so that it may engage and remove said paint roller sleeve from a paint roller.

* * * * *